US007226652B2

(12) United States Patent
Egger et al.

(10) Patent No.: US 7,226,652 B2
(45) Date of Patent: Jun. 5, 2007

(54) LARGE-SIZE OSB PANEL HAVING IMPROVED PROPERTIES, ESPECIALLY FOR THE CONSTRUCTION INDUSTRY

(75) Inventors: Michael Egger, St. Johann in Tirol (DE); Walter Schiegl, St. Johann in Tirol (DE); Gerhard Schickhofer, Graz (DE)

(73) Assignee: Fritz Egger GmbH & Co., Unterradlberg (AT)

( * ) Notice: Subject to any disclaimer, the term of this patent is extended or adjusted under 35 U.S.C. 154(b) by 0 days.

(21) Appl. No.: 10/480,563

(22) PCT Filed: Jun. 1, 2002

(86) PCT No.: PCT/EP02/06023

§ 371 (c)(1),
(2), (4) Date: Jul. 2, 2004

(87) PCT Pub. No.: WO02/101170

PCT Pub. Date: Dec. 19, 2002

(65) Prior Publication Data

US 2004/0241414 A1 Dec. 2, 2004

(30) Foreign Application Priority Data

Jun. 12, 2001 (DE) ..... 201 09 675 U

(51) Int. Cl.
*B32B 5/12* (2006.01)

(52) U.S. Cl. ..... 428/105; 428/106; 428/107; 428/108; 428/109; 428/111; 428/114; 428/212; 428/218; 428/537.1

(58) Field of Classification Search ..... 428/105, 428/106, 107, 108, 109, 111, 114, 212, 218, 428/537.1
See application file for complete search history.

(56) References Cited

U.S. PATENT DOCUMENTS 5,554,429 A * 9/1996 Iwata et al. ..... 428/105
5,951,795 A * 9/1999 Calve et al. ..... 156/62.8
6,053,052 A * 4/2000 Starostovic ..... 73/851

FOREIGN PATENT DOCUMENTS

DE 19503343 * 6/1996
DE 19746383 4/1999

* cited by examiner

*Primary Examiner*—Leszek Kiliman
(74) *Attorney, Agent, or Firm*—Proskauer Rose LLP

(57) ABSTRACT

The invention relates to a large-size OSB-board having improved technical and mechanical properties. The aim of the invention is to solve the technical problems posed by an OSB-board which is suitable for using on large surfaces and also, for example, for the construction of buildings. To this end, the board has a width of at least 2.60 m and a length of at least 7.0 m, and the flectional elasticity module is it least 700 N/mm$^2$ in the main loading direction.

24 Claims, 3 Drawing Sheets

LARGE-SIZE OSB PANEL HAVING IMPROVED PROPERTIES, ESPECIALLY FOR THE CONSTRUCTION INDUSTRY

BACKGROUND OF THE INVENTION

An OSB panel in the sense of the present invention consists of at least one layer constituted by flat wood chips, so-called strands. The strands of this layer are oriented in a preferred direction (here in production direction=longitudinal panel direction. Even in the case of a single-layer panel, a lower and a mirror-equal upper face sheet are normally combined into an internally homogenous layer in course of manufacture of this panel.

In case of a multi-layered construction, the previously described layer constitutes the lower and upper face sheet, and the medial layer (in case of a 3-layer model) with no preferred orientation of the strands is located between them. This dispersion is also designated as "random" in language of the specialized field. The innermost layer of the panel is designated as the medial layer. Thus a 3-layer panel consists of an upper and a lower face sheet and a medial layer, a 5-layer panel or one with more layers consists of an upper and lower face sheet of a medial layer and of layers between the upper or the lower face sheet and the medial layer. A preferred embodiment of the invention is in form of a 3-layer panel, a 5-layer panel or one with even more layers (whereby an odd number of layers is rational). Even numbers of layers are however just as possible.

SUMMARY OF THE INVENTION

It is the technical aim of the invention to indicate an OSB panel suitable for utilization on large surfaces, e.g. one that can also be used to erect buildings.

The above technical aim is attained through the invention by an OSB panel having the characteristics of claim 1. Additional embodiments are indicated in the sub-claims and are described in detail further on.

The present invention describes a large-size panel of wooden material, a building component produced from it as well as a process for the production of a large-size panel with high mechanical properties such as e.g. the parameters for flexion, traction and pressure without increasing the specific weight of the panel beyond the normal extent for that purpose. In addition, technological properties of an OSB panel are described through which these improved mechanical properties can be obtained, as well as possible utilizations of this OSB plate.

The strand geometry (length, width, thickness), the orientation of the strands within a layer in a desired direction, the amount and type of the bonding material or of the mixture of several bonding materials, the amount of additives such as hardeners and paraffin, the thickness relationship between the outermost layer and the medial layers or layer, the density profile that is influenced by targeted control of the process parameters and finally the overall panel thickness and the panel size, adapted to the intended application, are all influence parameters for the preferred embodiments of the present invention.

The present invention as well as its preferred embodiments makes it possible to achieve the following mechanical and technological properties. These should be understood to be minimum values and are indicated as mean values. The dispersion of the parameters is low because of manufacturing conditions. The properties are determined in accordance with EN 789:1995 "Testing Methods for Wooden Structures—Determination of the mechanical Properties of Wood Materials". This standard regulates the determination of characteristic properties of wood materials used in construction of bearing purposes. The designation "longitudinal" means that the orientation of the strands in the upper face sheet is parallel to the sample length in the sense of EN 789, and "transversal" indicates a strand orientation perpendicular to the sample length. The following indications relate as an example to panels with a minimum thickness of 25 mm. Even higher parameters are to be expected as a rule for thinner panels.

Flectional strength perpendicular to the plane of the panel:
Longitudinal ∃ 30.0 N/mm$^2$ Transversal: ∃ 15.0 N/mm$^2$
Flectional elasticity modulus, perpendicular to the plane of the panel:
Longitudinal: ∃ 7000 N/mm$^2$ transversal: ∃ 3000 N/mm$^2$
Transversal strength in the plane of the panel
Longitudinal: ∃ 1.2 N/mm$^2$ transversal: ∃ 1.40 N/mm$^2$
Rigidity modulus in the plane of the panel:
Longitudinal: ∃ 200 N/mm$^2$ transversal: ∃ 190 N/mm$^2$
"Moist" resistance to pressure in the plane of the panel
Longitudinal: ∃ 24.0 N/mm$^2$ transversal: ∃ 16.5 N/mm$^2$
"Moist" elasticity of compression modulus in the plane of the panel
Longitudinal: ∃ 5000 N/mm$^2$ transversal: ∃ 3200 N/mm$^2$ For the moisture tests (designation "moist) the sample was stored for a period of 15 hours in water at room temperature before the test. The test was conducted with drained-off samples.

Flexural strength in the plane of the panel:
Longitudinal: ∃ 20 N/mm$^2$
Elasticity of tension modulus in the plane of the panel:
Longitudinal: ∃ 6000 N/mm$^2$
Resistance to pressure in the plane of the panel:
Longitudinal: ∃20.0 N/mm$^2$
Elasticity of compression modulus in plane of the panel:
Longitudinal: ∃ 6000 N/mm$^2$ In an additional embodiment of the invention the following properties apply:

Flectional strength, perpendicular to the plane of the panel:
Longitudinal: ∃ 35.0 N/mm$^2$ transversal: ∃ 10.0 N/mm$^2$
Flectional elasticity modulus, perpendicular to the plane of the panel:
Longitudinal: ∃ 8000 N/mm$^2$ transversal: ∃ 2000 N/mm$^2$ The properties of the wood material panels are influenced by the geometry of the strands and by the as much as possible uniform configuration of the strands of the face sheet, by the ratio of thickness of the face sheets and the overall thickness or of the weight per surface unit of the face sheet and the overall weight per surface unit of the panel and the median specific gravity (density) of the panel.

It has been shown that the following parameters regarding strand dimensions are advantageous in achieving the desired mechanical and technological properties:

Strands of the outer layers (face sheets):
Length: 130-180 mm
Width: 10-30 mm
Thickness: 0.4-1.0 mm
Strands of the medial layer:
Length: 90-180 mm
Width: 10-30 mm
Thickness: 0.4-1.0 mm Each of the two face sheets (outer layers) should consist in the finished product of at least 30 percent in weight of the overall dispersed chip quantity, so that the sum in the upper and in the lower face sheet represents a proportion of at least 60%. The remaining 40% represent the medial layer in a 3-layer panel. The specific gravity of the panel should amount at most to 700 kg/m$^3$, but a value of less than 650 kg/m$^3$ is to be desired. These data relate to dry panels.

As a rule, the strands are produced from round stock, preferably available in a debarked state. The round stock logs are conveyed to a chipping machine (flaker) that produces strands in the desired dimensions in one single pass through the rotating tools. However a multi-stage production of the strands is also possible, such as e.g. from a peeled veneer that is reduced into strands in another operation.

It is advantageous for the obtention of the desired properties if the part of minute particles is reduced to a minimum in the individual layers. A minute particle is to be understood as a strand with dimensions significantly different from the strand dimensions described earlier. The preponderance of minute particles should be avoided primarily in course of production, e.g. through careful debarking and periodic sharpening of the cutting tools of the flaker. It is however also possible to provide for the separation of minute particles after the production of the strands.

Of course the proportion of minute particles can only be reduced to a tolerable minimum but cannot be completely avoided, even when care is taken in strand production and in separation. The proportion of minute particles may easily represent 10 to 15 percent in weight of the weight of the finished panel.

The type of wood used for the strands is not relevant. In principle all types of wood such as e.g. poplar, birch, beech, oak, pine, fir etc. can be used. Fir wood has proven to be especially suitable because of its good chipping properties and its relatively high content in resin.

In order to reduce the swelling characteristics, paraffin or wax can be added. It can be applied in form of a melted mass at the higher temperature required for this (liquid wax application), or close to room temperature in case of emulsions.

Urea-formaldehyde binders (UF), melamine formaldehyde binders (MF), phenol formaldehyde binders (PF) binders on basis of isocyanate (e.g. PMDI) and also binders based on acrylates have proven to be effective binders. In most cases a mixture of at least two of these types of binders is used, but a mixture of several binder types is also possible. A mixture should not be understood to be only one consisting of different types of binders that are already usable, but also mixtures of different of the listed types resulting in course of production in form of mixture. Thus e.g. melamine-urea-formaldehyde binders (MUF) or melamine-urea-phenol-formaldehyde binders (MUPF) can be produced by boiling the ingredients together in the same reactor. The individual layers of the panel may also contain different types of binders and their mixtures, it being advantageous in case of multi-layer panels for reason of stability under load to provide the same types of binder or the same mixture for those layers that are placed in the same position relative to the panel surfaces. Thus it has been shown, for example, that the requirements of the invention in case of a 3-layer panel can be very well met if the upper and lower face sheets are provided with an MUPF binder, and the medial layer with a binder based on isocyanate (PMDI).

The proportion of binder and the type of binder are determining factors for the desired mechanical and technological properties. The content in binder depends on the type of binder. Binder content for UF, MF, PF and their mixtures are within a range from 10 to 15 percent in weight (in mixtures, the sum of the components used) calculated as solid resin relative to the dry mass of wood strands. When isocyanate is used the proportion of binder can be reduced to 5-10 percent in weight.

The strands are coated with binder before forming the strand mats. Large binder coating drums are normally provided for this purpose, making continuous binder coating possible in course of the pass. The drums rotate around their longitudinal axis and thereby keep the supplied strand material in constant movement. A fine binder mist that is deposited evenly on the strands is produced in the drums by means of nozzles. The drums contain integrated structures, on the one hand in order to be able to constantly grasp the strand material, and on the other hand in order to convey the strand material from the inlet going into the drum to the outlet. An inclination of the drum in longitudinal direction can assist the forward movement of the strand.

The desired mechanical and technological properties are achieved by the targeted orientation of the strands.

Especially in case of a single-layer panel as well as with the cover layers of multi-layer panels the orientation of the strands must preferably be in one direction (e.g. parallel to the longitudinal sense of the panel=production sense), whereby orientation shall be ensured to a great extent. Only a small percentage of chips may deviate by more than ∀ 15° from the selected direction of orientation. Nevertheless sufficient strength and rigidity still exists in "transversal" direction of the panel, since the dispersion process always produces a deviation from the target orientation.

In case of 3-layer or multi-layer panels the target orientation of the strands depends on the position of the strand layer within the panel. The two outermost layers, the face sheets, should be oriented parallel to the panel length as described above in case of a single-layer panel. In viewing a 3-layer OSB panel, the strands of the single medial layer are oriented without any preferred direction (random).

A panel consisting of more than 3 layers is also possible. As a rule the number of layers will be uneven, whereby the strand orientation of the face sheets and of the medial layer is as described above, and the orientation of the other layers may be in any desired direction. Thus it is possible that the preferred strand orientation of these other layers may be perpendicular to the strand orientation of each adjoining outer layer. However a random orientation of individual layers is also possible.

A dispersion machine achieves the forming of the strand mats from the different superimposed layers. As a rule, one dispersion head is provided for each layer. Its task is to arrange the binder-coated strands in the target direction or randomly. After the dispersion of the mats, pressing them into a stable panel-shaped product takes place under the action of pressure and temperature. This can be achieved through cadenced pressing (pressing for one or several days) or in continuously operating presses. The latter make it possible to produce an endless panel ribbon that can be cut down to the desired sizes.

The panels can be ground after being produced. Thereby a homogenous panel thickness with low thickness tolerances and improved conditions for the bonding together of two or more panels into structural components, as described below, can be achieved. However if the panel surface quality is sufficiently good and the thickness tolerance of the panels is sufficient, bonding without previous grinding is also possible.

BRIEF DESCRIPTION OF THE DRAWINGS

The invention is described in further detail through examples of embodiments, whereby reference is made to the enclosed drawings. In the drawings

DETAILED DESCRIPTION OF THE INVENTION

Figure 1:
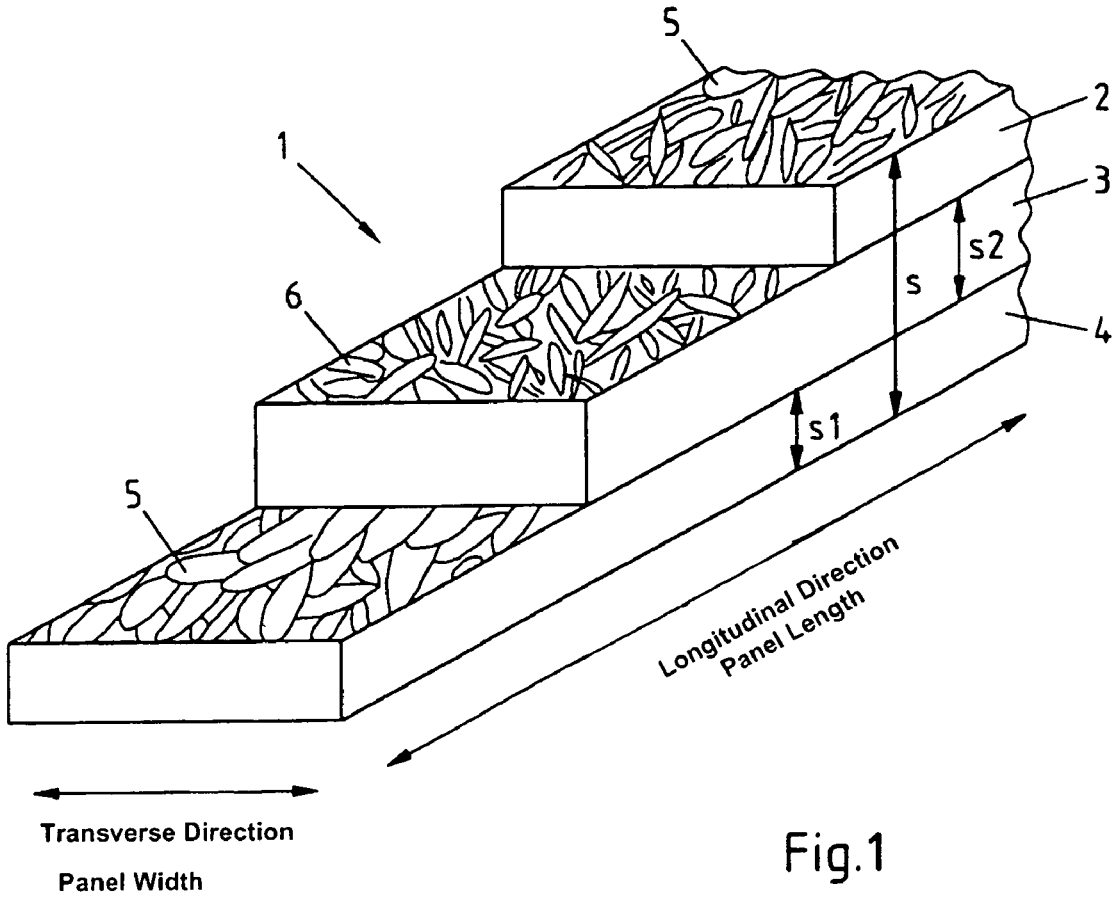
FIG. 1 shows a first embodiment of an OSB panel according to the invention.

FIG. 1 shows a wood material panel 1 consisting as described earlier of three layers of strands. The upper strand layer 2 shows a preferred orientation of the strands 5 in the longitudinal direction of the panel. It can be seen that the strands 5 of the strand layer 2 are not strictly parallel to the long side of the panel, but that nevertheless a high degree of orientation is achieved. The medial layer 3 is made up of strands 6 that are somewhat shorter than the strands of the face sheets 2 and 4. The orientation of the strands 6 of the medial layer 3 is random. The lower face sheet 4 is a mirror image of the upper face sheet 2. The terms "panel length" and "panel width" for the panel 1 shown in FIG. 1 are selected only as example reference values for a detail of a large panel and need not represent the actual dimensions, panel length and panel width. In addition, FIG. 1 shows that the thickness s1 of each of the two face sheets (the lower face sheet 4 as well as upper face sheet 2, structured as a mirror image) is 30% of the overall thickness s of the panel and the thickness s2 of the medial layer 3 is approximately 40%.

The single plate 1 produced according to the process described above may have a thickness s up to 50 mm and dimensions of 2.8×15 m and may be used for various applications in the building field. The panel length of 15 m should definitely not be regarded as a maximum limit. However it has been shown that in manufacture as well as for the subsequent handling of panels in course of further processing, a useful size is around 10 to 15 meters.

Figure 2:
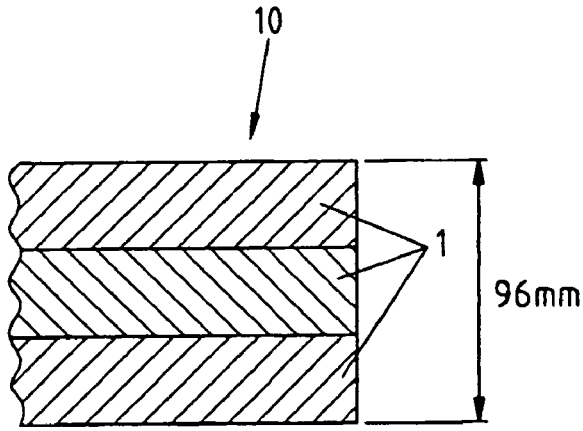
FIG. 2 shows the structure of layers in the OSB panel.

If several panels (e.g. 3×32 mm=96 mm) are combined into a sandwich element of greater thickness, components with large surfaces can be obtained. FIG. 2 schematically shows such a component 10 consisting of 3 single panels 1. In addition the single panels 1 are glued together by means of a binder such as e.g. isocyanate at least partially over large surfaces. Such a component can be used e.g. in building construction for outer and inner walls, with the advantages that elements can be produced without seams to match the length of the wall over a full story height (up to 2.8 m). Current building construction experience (e.g. one-family home, multi-family home) shows that wall elements with a length between 10 and 15 meters are quite sufficient for the production of entire wall, ceiling and roof elements. Regarding the length of panels or components, it should be considered that during the transportation of these elements from the place of manufacture to the place of further processing or utilization, certain limits do exist. Maximum panel and component lengths should also be considered from this point of view. The needed openings such as windows and doors can be produced by means of the usual tools such as saws and grinders normally used for massive wood.

From the above-mentioned sandwich elements with large surfaces it is also possible to make supports in such manner that the strips can be produced in the desired support width or support height. The strips are cut according to the panel length, so that a support length up to 15 m is possible. These supports can be combined on one or both sides with large-format OSB panels to constitute ceiling, wall or roof elements having sufficient stability to bridge spans of several meters.

Figure 3B:
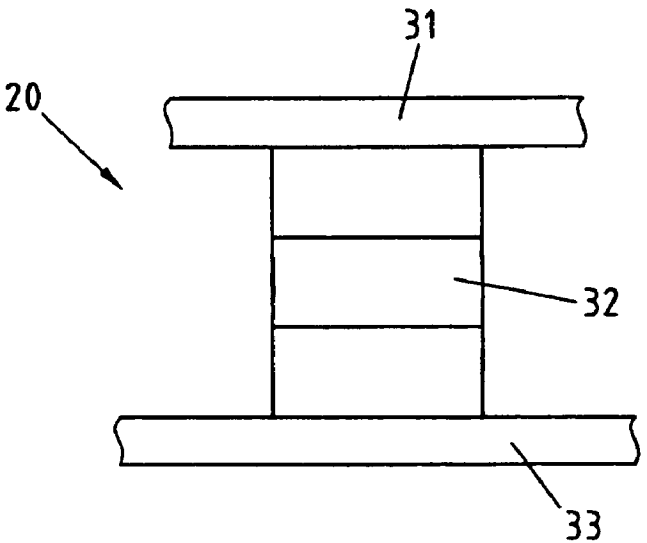
FIG. 3 shows two examples of a structural element produced from OSB panels and FIG. 4 shows the structure of a structural element with large surface produced from OSB panels.
Figure 3A:
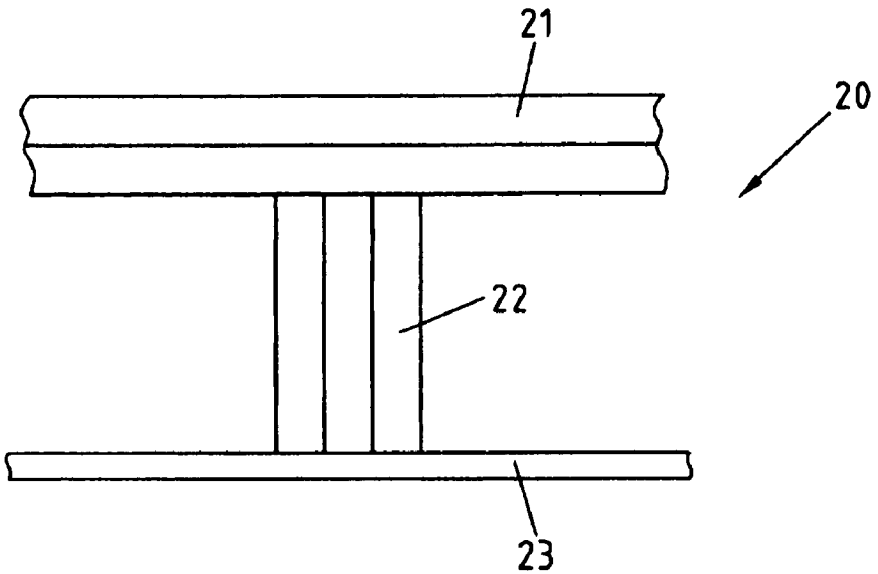

FIG. 3 shows two different embodiments and a lower panel 23. The panel 21 itself consists again of 2 single plates 1, the support 22 itself consists of single plates 1. The panels 21 and 22 are combined with the support 22 in a positively locking or non-positively interlocking manner. If component 21 is a ceiling element, the panel 21 assumes the function of floor of the upper story and the panel 23 the function of ceiling of the lower story. This also applies in the same sense to FIG. 3*b*. Here the component 20 consists of an upper panel 31 made up of only one single panel 1, then of the support 32 and of the lower panel 33. Contrary to the support 22, the support 32 is placed lying flat.

Figure 4:
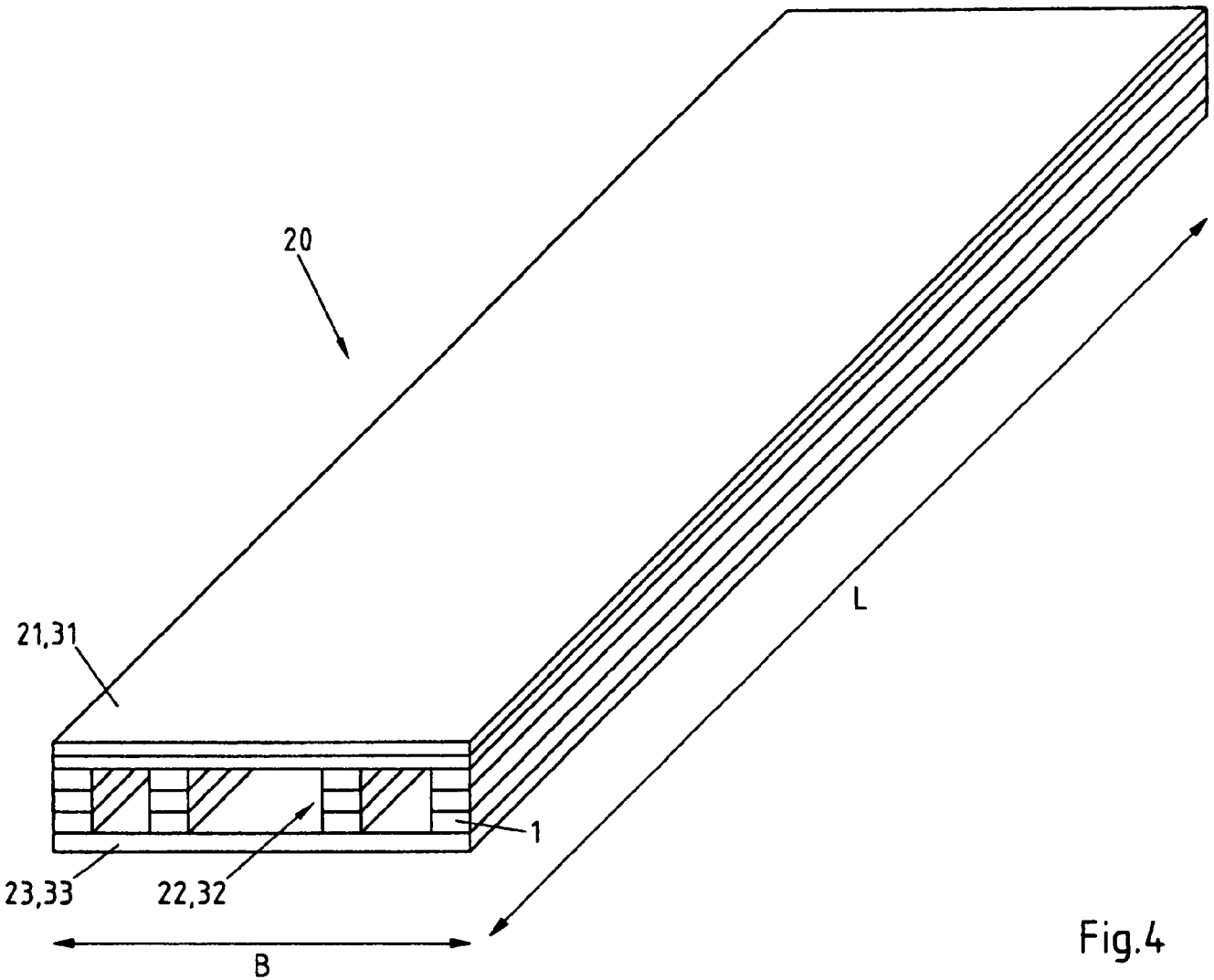

FIG. 4 shows the structure of a large-surface building element 20 consisting of a plurality of single panels 1. The length L may be up to 15 m and the width B up to 2.8 m. The supports 23, 33 are fixedly connected to the panels 21, 31 and 22, 32. As a result the component possesses a great bearing capacity in combination with the good mechanical and technological properties of the single panels 1 themselves.

EXAMPLE 1

The 3-layer OSB panel in the following example was produced in an industrial plant.

The production of the strands of the central and face sheets takes place on separate processing lines until formation of the mats. Strands with a length of approximately 150 mm, a width between 10 and 25 mm and a thickness between 0.5 and 0.8 mm are produced from debarked pine logs. Minute material is already separated as much as possible. The drying which follows reduces the moisture content of the strands of both layers to a value between 3 and 5%. Before adding the binder, the proportion of minute material is minimized by means of a sieving arrangement. The binder is added in binder coating drums, whereby the face sheet is mixed with approximately 13% in weight of a melamine-urea-phenol-formaldehyde binder (solid resin relative to dry wood mass) and the medial layer with 8% in weight of a PMDI binder.

The mats are then formed over a width of approximately 2.80 m, whereby the strands of the lower face sheet with a strand orientation in production direction are laid down first, then the medial layer with random dispersion and without unidirectional orientation of the strands, and finally the upper face sheet with a strand orientation that is also in production direction. The weight per surface unit of the lower face sheet, relative to the overall mat weight, is 36%, that of the medial layer 28% and that of the upper face sheet also 36%. The mat thus obtained is compressed into an OSB panel with a final thickness of 33.5 mm under the action of pressure and temperature, and the endless panel produced in a continuous process is then cut down into panels measuring 12.0×2.80 m. Following a maturation time of 5 days, the panel possesses the following properties (median value over 5 tests):

Flectional strength according to EN 789 perpendicular to the plane of the panel, longitudinal: 36.9 N/mm$^2$ Flectional elasticity modulus according to EN 789 perpendicular to the plane of the panel, longitudinal: 8322 N/rnm$^2$ (maximum value 8816 N/mm$^2$)

Density at approximately 12% moisture: 645 kg/m$^3$

Panel density at 0% moisture: 585 kg/m$^3$

Three panels obtained in this manner were ground down to a thickness of 32 mm and were bonded together under pressure over their entire surface by means of a binder based on isocyanate into a panel element with an overall thickness of 96 mm. The sandwich element that was thus obtained has the same dimensions as the single panels (2.80×12.0 m) and possesses the following properties (median value over 5 tests):

Flectional strength according to EN 408 perpendicular to the plane of the panel, longitudinal: 23.8 N/mm$^2$ Flectional elasticity modulus according to EN 408 perpendicular to the plane of the panel, longitudinal: 6393 N/mm$^2$ (The German Industrial Standard (DIN) EN 408, March 2001 edition under the title "Wooden structures—construction wood for bearing purposes and layered panel wood—determination of several physical and mechanical properties" defines testing methods for the determination of the dimensions, wood moisture and density, and describes the conditions of the testing samples of construction wood for bearing purposes and for layered panel wood. This standard was used oto test the sandwich elements described above).

EXAMPLE 2

The 3-layer OSB panel in the following example was produced in an industrial plant.

The production of the strands of the central and face sheets proceeds until mat formation on separate product ion lines. Strands approximately 140 mm long, from 10 to 30 mm wide and approximately 0.6 mm thick are produced from debarked pine logs. Minute particles are already separated as much as possible. The then following drying process reduces the moisture content of the strands of both layers to a value from 3 to 5%. Before the addition of binder, the proportion of minute material is minimized by means of a sieving apparatus. The addition of binder takes place in binder coating drums, whereby the face sheet was mixed with approximately 7.0% in weight of PMDI (solid resin in relation to dry wood mass) and the medial layer was mixed with 5.5% in weight of a PMDI binder.

The mat is then formed over a width of approximately 2.80 m, whereby the strands of the lower face sheet with a strand orientation in production direction are laid down first, and then the randomly dispersed medial layer without unidirectional strand orientation, and finally the upper face sheet having a strand orientation that is also in production direction. The weight per surface unit of the lower face sheet relative to the overall mat weight is 35%, that of the medial layer 30% and that of the upper face sheet also 35%. The mat obtained in this manner is compressed under the action of pressure and temperature into an OSB panel with a final thickness of 24.8 mm, and the endless panel produced in continuous process is then cut into formats of 12.0×2.80 m. Following a maturation time of 5 days the panel which has not been ground just as in example 1, possesses the following properties (mean value over 10 tests):

Flectional strength according to EN 310 perpendicular to the plane of the panel, longitudinally: 51.5 N/mm$^2$ Flectional elasticity modulus according to EN 310, perpendicular to the plane of the panel, longitudinally: 8351 N/mm$^2$ (maximum value 9004 N/mm$^2$)

Flexural strength according to EN 408 in the plane of the panel, longitudinally: 25.3 N/mm$^2$ (mean value over 4 tests)

Elasticity of tension modulus according to EN 310 in the plane of the panel, longitudinally: 7392 N/mm$^2$ (mean value over 4 tests)

Panel moisture: approximately 8%

Panel density at 0% moisture: 629 kg/m$^2$

EXAMPLE 3

The single-layer OSB panel of the following example was produced in an industrial plant.

Strands approximately 140 mm long, from 10 to 30 mm wide and from 0.5 to 0.6 mm thick are produced from debarked pine logs. Minute particles are already separated as much as possible. The then following drying process reduces the moisture content of the strands to a value from 3 to 5%. Before the addition of binder, the proportion of minute material is minimized by means of a sieving apparatus. The addition of binder takes place in binder coating drums, whereby the mixing was effected with approximately 7.0% in weight of PMDI (solid resin in relation to dry wood mass). (In agreement with Wismar)

The unidirectional mat forming then takes place in production direction by means of two dispersion heads in a row over a width of approximately 2.80 m. No "crosswise" or "randomly" oriented medial layer is dispersed. The mat obtained in this manner is compressed under the action of pressure and temperature into an OSB panel with a final thickness of 24.8 mm, and the endless panel produced in continuous process is then cut into formats of 12.0×2.80 m. Following a maturation time of 5 days the panel which has not been ground possesses the following properties (mean value over 10 tests):

Flectional strength according to EN 310 perpendicular to the plane of the panel, longitudinally: 47.2 N/mm$^2$ Flectional elasticity modulus according to EN 310, perpendicular to the plane of the panel, longitudinally: 8488 N/mm$^2$ Flexural strength according to EN 408 in the plane of the panel, longitudinally: 24.2 N/mm$^2$ (mean value over 4 tests)

Elasticity of tension modulus according to EN 310 in the plane of the panel, longitudinally: 7275 N/mm$^2$ (mean value over 4 tests)

Panel moisture: approximately 8%

Panel density at 0% moisture: 614 kg/m$^2$

The invention claimed is:

1. Large-size, multi-layer OSB panel with improved mechanical and technological properties, at least 7.0 m long, from 12 to 50 mm thick and having a specific gravity of at most 700 kg/m$^3$ at 0% moisture content, wherein the panel comprises at least two layers of compressed strands and a binder, the strands of the face sheets are from 130 to 180 mm long and from 10 to 30 mm wide with a thickness between 0.4 and 1.0 mm and the flectional elasticity modulus in the main load-bearing sense is at least 7000 N/mm$^2$.

2. OSB panel as in claim 1, wherein the panel is at least 25 mm thick.

3. OSB panel as in claim 1, wherein the plate is at least 2.60 m wide.

4. OSB panel as in claim 1, wherein the panel comprises an uneven number of layers.

5. OSB panel as in claim 1, wherein the outer face sheets have strands oriented in the longitudinal direction of the panel and the strands of the medial layer of the panel are without any recognizable orientation.

6. OSB panel as claim 1, wherein the strands of the medial layer or medial layers are offset by 90° from a target orientation of the directly adjoining outer layer, whereby the maximum deviation is 30°.

7. OSB panel as in claim 1, wherein the strands of the medial layer are from 130 to 180 mm long.

8. OSB panel as in claim 1, wherein the thickness of at least one of the outer face sheets is at least 30% of the overall thickness of the panel.

9. OSB panel as in claim 1, wherein the panel is at least 11 m long.

10. OSB panel as in claim 1, wherein the binder comprises a urea-formaldehyde binder (UF), a melamine-formaldehyde binder (MF), a phenol-formaldehyde binder (PF), an isocyanic base binder, an acrylic base binder, or a mixture thereof.

11. OSB panel as in claim 10, wherein the binder used is a melamine-urea-formaldehyde binder (MUF) or a melamine-urea-phenol-formaldehyde binder (MUPF).

12. OSB panel as in claim 10, wherein the binder comprises a mixture of at least two binders mentioned in claim 10.

13. OSB panel as in claim 1, wherein the proportion of binder 6 represents up to 18% solid binder relative to the dry mass of wood.

14. OSB panel as in claim 1, wherein the panel contains paraffin or wax in order to reduce the swelling characteristics.

15. OSB panel as in claim 1, wherein the specific gravity of the panel at 0% moisture is at most 650 $kg/m^3$.

16. OSB panel as in claim 1, wherein the panel constitutes large one-piece and seamless surfaces and is part of a construction component.

17. OSB panel as in claim 16, wherein the panel is part of a wall construction of a house, whereby the panel width is equal to the story height and the panel length is equal to the wall length.

18. OSB panel as in claim 16, wherein the panel is up to 15 m long and up to 2.8 m wide.

19. Component with at least two OSB panels as in claim 1, wherein the panels are bonded to each other at least partially.

20. Component as in claim 19, wherein the panels are combined over large surfaces and without seams and are a bearing wall structure equal to the height of at least one story.

21. OSB panel as in claim 2, wherein the panel has a thickness of 28 to 42 mm.

22. OSB panel as in claim 3, wherein the plate is at least 2.80 m wide.

23. OSB panel as in claim 4, wherein the panel includes 3 layers.

24. OSB panel as in claim 10, wherein the binder used comprises PMDI.

* * * * *